United States Patent [19]

Nonnenmacher et al.

[11] 3,985,065

[45] Oct. 12, 1976

[54] RADIAL PISTON MACHINE

[75] Inventors: Gerhard Nonnenmacher, Korntal; Roland Steinmann, Stuttgart, both of Germany

[73] Assignee: Robert Bosch G.m.b.H., Stuttgart, Germany

[22] Filed: May 19, 1975

[21] Appl. No.: 578,912

[30] Foreign Application Priority Data

May 18, 1974 Germany ..... 2424284

[52] U.S. Cl. ..... 91/498

[51] Int. Cl.[2] ..... F01B 13/06

[58] Field of Search ..... 91/484, 485, 489, 491, 91/498

[56] References Cited

UNITED STATES PATENTS

| | | | |
|---|---|---|---|
| 3,082,696 | 3/1963 | Henrichsen | 91/489 |
| 3,875,852 | 4/1975 | Bosch | 91/498 |

FOREIGN PATENTS OR APPLICATIONS

| | | | |
|---|---|---|---|
| 1,928,763 | 6/1969 | Germany | 91/492 |
| 958,028 | 5/1964 | United Kingdom | 91/498 |
| 1,239,955 | 6/1968 | United Kingdom | 91/498 |

*Primary Examiner*—William L. Freeh
*Attorney, Agent, or Firm*—Michael J. Striker

[57] ABSTRACT

A radial piston machine, such as a pump or a motor, has a housing in which a cylinder body is rotatable. The cylinder body has radial cylinder bores which accommodate reciprocable pistons. A shaft mounts the cylinder body for rotation and is formed with two axially spaced circumferential grooves between which it is also formed with a high-pressure control opening and with a diametrically opposite low-pressure control opening; these openings communicate intermittently with the inner ends of the cylinder bores. Sealing lands are formed on the shaft intermediate the grooves and the openings, and supporting lands are formed axially outwardly of the grooves. The supporting lands are formed with four part-circumferential recesses arranged in pairs, the recesses of each pair axially flanking one of the control openings, and the recesses of one pair being communicated with a space having a fluid pressure lower than that of the control opening which they flank and/or the recesses of the other pair being communicated with the circumferential grooves.

18 Claims, 11 Drawing Figures

RADIAL PISTON MACHINE

BACKGROUND OF THE INVENTION

This invention relates to a radial piston machine, such as a pump or motor.

Radial piston machines are well known in the art and are, therefore, not considered to require a detailed description as to their operation. It is known that the pressure acting on the cylinder bores of the rotor, which are located at the high-pressure side, presses the rotor against the mounting shaft in the area of the high-pressure fluid control opening. This force is opposed by pressure fields which develop in the gap between the shaft and the rotor, above the sealing lands and supporting lands in the region of the high-pressure control opening; it is also opposed by the force which acts above the high-pressure control opening upon the rotor.

Depending upon the dimensioning of the sealing lands and the supporting lands, and of the high-pressure control opening, the forces of the pressure fields which tend to lift the rotor body off the shaft may be greater than the force pressing it against the shaft. If this occurs, the rotor will contact the shaft in the region of the low-pressure fluid control opening with a consequent enlargement of the space between the shaft and rotor in the region of the high-pressure control opening, and with a concomitant undesirable increase in leakage losses.

SUMMARY OF THE INVENTION

It is an object of this invention to provide a radial piston machine which avoids the aforementioned disadvantages of the prior art.

More particularly, it is one object of the invention to provide an improved radial piston machine in which the gap dimension between shaft and rotor in the region of the high-pressure fluid control opening is maintained small due to automatically acting hydrostatic pressure compensation.

In keeping with these and other objects which will become apparent hereafter, one feature of the invention resides in a radial piston machine, i.e., a radial fluid motor or pump, which, briefly stated, comprises a housing; a shaft in said housing and formed with two axially spaced circumferential grooves and intermediate the same with a high-pressure fluid control opening and with a diametrically opposite low-pressure fluid control opening, sealing lands intermediate said control openings and said circumferential grooves, a first and a second set of supporting lands adjacent said circumferential grooves at the axially outwardly directed sides thereof, a first pair of part-circumferential recesses formed in said first set and axially flanking said high-pressure fluid control opening and a second pair of part-circumferential recesses formed in said second set and axially flanking said low-pressure fluid control opening; a cylinder barrel rotatably mounted on said shaft and formed with cylinder bores having inner ends which intermittently communicate with the respective control openings; pistons reciprocable in the respective cylinder bores; and means communicating the recesses of said first pair with a space having a fluid pressure lower than that of said high-pressure fluid control opening and/or communicating the recesses of said second pair with said circumferential grooves.

The circumferential grooves receive leakage fluid; as long as any significant fluid pressure prevails in these grooves, the hydrostatic forces acting above the supporting lands in the region of the high-pressure fluid control opening are reduced and/or those in the region of the low-pressure fluid control opening are increased. Therefore, the gap height (in radial direction) in the region of the high-pressure control opening is decreased which results in a concomitant reduction of fluid leakage losses. This is achieved without the equilibrium of forces at the shaft being so changed that a metallic contact between shaft and rotor could occur, leading to wear due to friction.

The avoidance of such contact is assured, due to the fact that the fluid pressure in the circumferentially complete grooves drops, as leakage losses drop, until a condition of equilibrium is achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
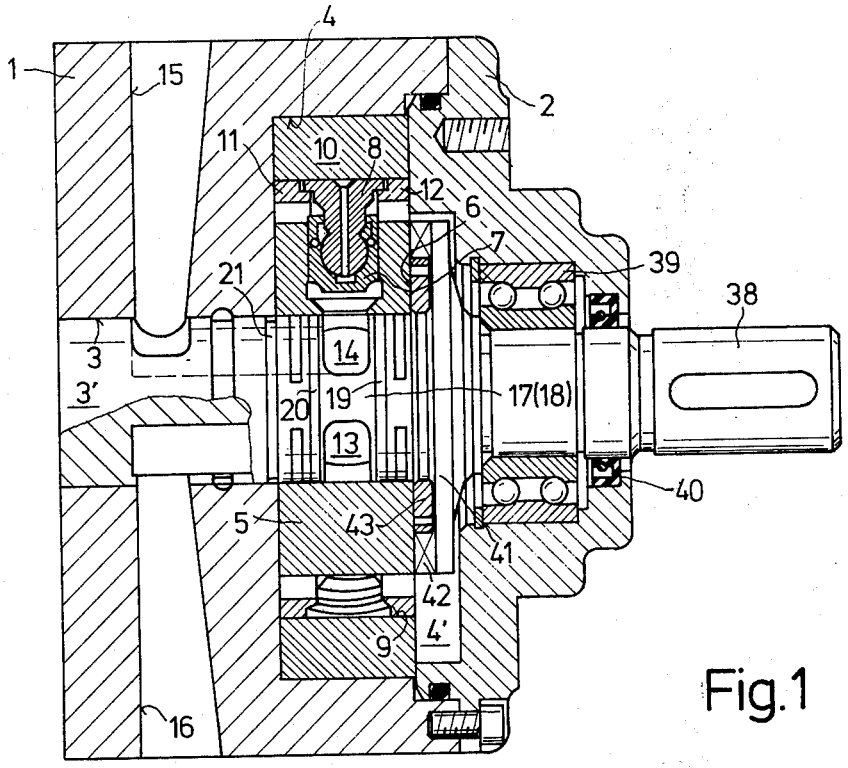
FIG. 1 is an axial section through a radial piston machine according to one embodiment of the invention.
Figure 2:
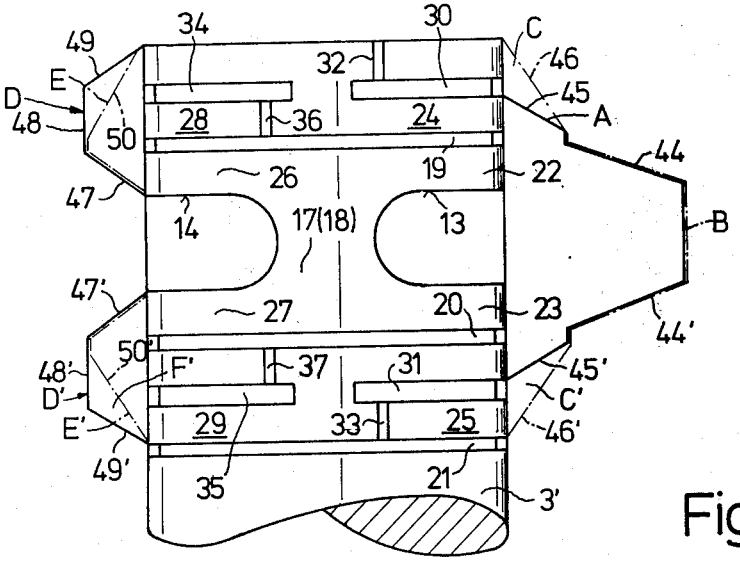
FIG. 2 is a fragmentary plan view showing details of the shaft of the machine in FIG. 1.

FIGS. 1 and 2 illustrate a first embodiment of the novel radial piston machine. It has a substantially cup-shaped housing 1, the open end of which is closed by an end cover 2. At the end remote from the end cover 2 the housing is provided with a bore which extends inwardly and communicates with an approximately oval chamber portion 4 of the housing chamber 4'.

A shaft 3' is press-fitted into the bore 3 and has a shaft portion which extends into the chamber portion 4. Located in the latter, and turnably mounted on the shaft portion therein is a rotor or cylinder body 5 that is formed with radial cylinder bores 6, each of which accommodates a reciprocable piston 7. The radially outer ends of the pistons 7 contact the inner circumferential surface of a control ring 10 which surrounds the cylinder body 5 eccentric to the axis of rotation of the same. The contact between pistons 7 and surface 9 is established via glide shoes 8 of which one is provided for each piston 7. It will be appreciated that the machine of FIGS. 1–2 has piston strokes which are not adjustable, but that such adjustability could be readily provided by making the degree of eccentricity of ring 10 relative to the axis of rotation of cylinder body 5 variable; this is already known per se in the art. Retaining rings 11, 12 prevent the glide shoes from lifting off the surface 9.

The shaft 3' is provided with two diametrically opposite fluid control openings 13 and 14 which cooperate with the radially inner ends of the cylinder bores 6 and which respectively communicate with channels 15, 16 (that are formed in part of the housing 1 and in part in the shaft 3') for the supply and removal of pressure fluid. In this embodiment, the opening 13 is the high-pressure fluid opening and the opening 14 is the low-pressure fluid opening. The openings 13, 14 are separated by wall portions 17, 18 and at opposite axial sides of the openings 13, 14 (seen relative to the axis of shaft 3') there are formed respective circumferential grooves 19, 20, each of which is circumferentially complete. Shaft 3' is further provided with an annular groove 21 at that axial side of groove 20 which faces away from openings 13, 14; groove 21 is located in a plane parallel to that of groove 20 and is provided where the bore 3 merges into the chamber portion 4. Groove 21 is in pressure-equalizing communication (not shown) with the chamber 4'.

FIG. 2 shows details of the shaft 3'. It illustrates clearly that sealing lands 22, 23 are provided intermediate the opening 13 and the grooves 19, 20. At the axial side of groove 19 which faces away from end cover 2, approximately in the region of opening 13, there is provided a supporting land 24. A further supporting land 25 is located between the grooves 20 and 21. Similar sealing lands 26, 27 are located between the opening 14 and the respective grooves 19, 20; a further supporting land 28 is located adjacent groove 19 at the axial side thereof facing the end cover 2, and another supporting land 29 is located between the grooves 20 and 21.

The supporting lands 24, 25 at opposite axial sides of opening 13 are provided with respective part-circumferential recesses 30, 31 which extend parallel to grooves 19, 20 over approximately the same circumferential distances as opening 13. Recess 30 communicates with the chamber 4' via a channel 32 that extends axially of the shaft 3' to that end of the shaft that faces end cover 2. A similar axial channel 33 in the periphery of shaft 3' connects the recess 31 with the groove 21, which in turn communicates with the chamber 4'. The supporting lands 28, 29 at opposite axial sides of opening 14 are provided with respective part-circumferential recesses 34, 35 which extend over approximately the same circumferential distance as opening 14 and which communicate with their adjacent grooves 19, 20 via respective axial channels 36, 37.

A drive shaft 38 is journalled for rotation in an anti-friction bearing 39 which is mounted in the end cover 2 and is sealed by a shaft seal ring 40. The shaft 38 merges at its inner end which is located in the chamber 4', into a flange 41 which engages with two claws 42 in corresponding slots of a coupling plate 43, which in turn is provided with two further claws that are offset angularly relative to the slots by 90° and which extend into corresponding slots of the cylinder body 5 (this is not shown) so that the cylinder body 5 is coupled with the shaft 38 for joint rotation.

As mentioned before, the opening 13 is the high-pressure fluid control opening and the opening 14 is the low-pressure fluid control opening. The high-pressure fluid which flows from the opening 13 to the grooves 19 and 20 causes the build-up of pressure fields above the sealing lands 22 and 23; these fields have a high carrying capacity. The pressure of the pressure fluid drops approximately linearly from the opening 13 to the pressure which prevails in the grooves 19 and 20 and which latter depends upon the gap height (in radial direction) between the shaft 3 and the inner circumferential surface bounding the opening in the cylinder body 5 through which the shaft extends, both at the high-pressure side and at the low-pressure side; it also depends on the spacing of the grooves 19 and 20 from the opening 13 and from other factors which, however, are of less importance.

The pressure in the gap mentioned above is constant above the opening 13 and decreases along straight lines 44, 44' until it reaches the lower pressure prevailing in the grooves 19 and 20. From the grooves 19 and 20, the pressure again decreases substantially linearly to the recesses 30 and 31 in which—due to the channels 32, 33—a pressure prevails that corresponds to the pressure in the interior of the chamber 4'. Straight lines 45 and 45' identify this latter pressure drop. The total pressure relationship in the region of the opening 13 is identified in FIG. 2 by the curve A. If the recesses 30 and 31 were not present, as is the case in the prior-art radial piston machines, the pressure would linearly decrease from the grooves 19, 20 to the pressure in the interior of the chamber 4' at the end of the shaft 3' or in the groove 21. Such a pressure drop is identified by the straight lines 46, 46' and the pressure curve which would be obtained under these circumstances in the region of the opening 13 is identified by the curve B. The area C, C' intermediate the straight lines 45 and 46, and 45' and 46', is a measure of the reduced carrying capability of the pressure fields which develop in the region of the opening 13. The pressure which prevails in the grooves 19 and 20 is uniform over the entire circumference of the shaft 3'; due to the presence of the channels 36 and 37 it also develops in the recesses 34 and 35. In the region of the low-pressure opening 14, the pressure drops from that prevailing in the grooves 19, 20 in a linear manner to the pressure of the low pressure opening, as indicated by the straight lines 47, 47'. Between the grooves 19, 20 and the recesses 34, 35 the pressure is unchanged, as indicated by the straight lines 48, 48', and from the recesses 34, 35 it drops linearly to the pressure of the chamber 4' towards the end of the shaft 3' or the groove 21, respectively, as indicated by the straight lines 49, 49'. The total pressure curve in the region of the low-pressure control opening 14 is identified by the pressure curves D and D' which are identical, assuming that the pressure in the grooves 19 and 20 is also identical.

The recesses 34, 35 and the channels 36, 37 are also not present in the prior-art radial piston machines. It is important to note that in the absence of the recesses 34, 35 and the channels 36 and 37, the pressure would drop from the grooves 19, 20 to the pressure of the chamber 4′ or of the groove 21, as indicated by the straight lines 50, 50′. This would result in a pressure curve in the region of the low-pressure control opening 14 as identified by the curves E and E′. The area included between the straight lines 48, 49, 50 and 48′, 49′, 50′ is identified with reference characters F and F′, respectively, and is a measure for the increase in the supporting capabilities of the pressure field in the region of the low-pressure control opening 14.

Due to the reduction of the supporting capability of the pressure fields in the region of the high-pressure control opening 13 (area C, C′) and the increase of the supporting capability of the pressure field in the region of the low-pressure control opening 14 (area F, F′) a displacement of the cylinder body 5 relative to the shaft 3′ in radial direction is obtained so that the gap height between the two of them is reduced in the region of the high pressure control opening 13. The less the height of the gap in the region of the opening 13, however, the less the quantity of leakage fluid which can run out through this gap, and consequently the less will be the pressure in the grooves 19 and 20. The result of this decrease in the pressure in the grooves 19 and 20 is that the carrying capability of the pressure field above the supporting lands 24, 25, 28 and 29 also decreases. The supporting capability of the pressure fields at the low-pressure side characterized by the areas below the curves D and D′, decreases relatively more strongly than the supporting capability of the pressure field at the high pressure side, identified by the area under the curve A. Before the cylinder body 5 comes in contact with the shaft 3′ at the high-pressure side, the reduction of the pressure in the grooves 19, 20 causes an equilibrium of all forces acting upon the cylinder body 5 to become established, and at this equilibrium condition the gap height in the region of the high-pressure control opening 13 is particularly small—as intended according to the invention—, and a metallic contact between the cylinder body 5 and the shaft 3′ is precluded. The leakage losses of the machine are substantially decreased by this measure.

If other forces act also upon the cylinder body 5, for example if the machine is installed in a vehicle, which forces tend to move the cylinder 5 out of the equilibrium condition and to cause a further decrease of the gap height in the region of the high-pressure control opening 13, then the pressure in the grooves 19, 20 decreases due to the reduction of the leakage fluid on the one hand, and due to the increased outflow of pressure fluid from the grooves 19, 20 as a result of the increased gap height at the low-pressure side on the other hand, so that the previously described effect is intensified. Even small shifts in the position of the cylinder body 5 radially of the shaft 3′ cause a significant change in the supporting capability of the pressure field—in a sense resulting in a decreased supporting capability at the low-pressure side and an increased supporting capability of the high-pressure side—so that a metallic contact between shaft 3′ and cylinder body 5 that could result in wear due to friction is avoided with certainty. If, on the other hand, the aforementioned external forces act in a different direction, which tends to increase the gap height in the region of the high pressure control opening 13, then the amount of leakage fluid which exits and the pressure in the grooves 19, 20 increases initially. This results in a relatively stronger increase of the supporting capability of the pressure fields at the low-pressure side and the cylinder body 5 is thereby shifted in the direction towards the original equilibrium condition where the decreased gap height obtains.

Figure 3:
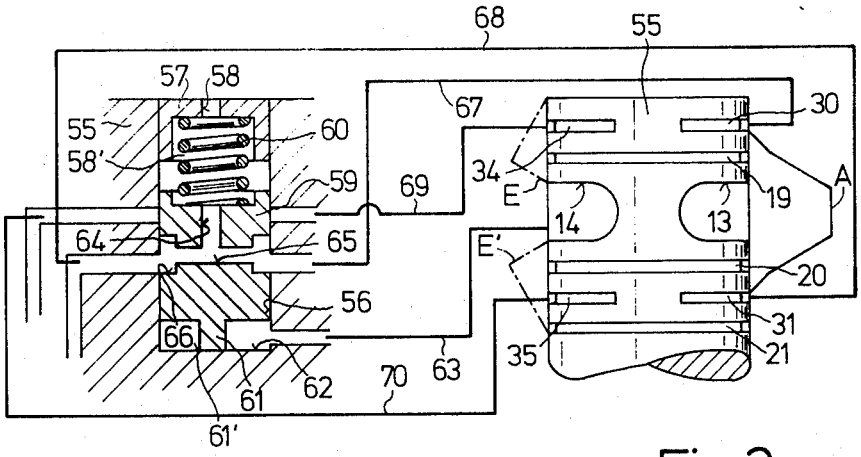
FIG. 3 is a diagrammatic fragmentary view, partly in section, illustrating a further embodiment of the invention.

FIG. 3 shows an embodiment of a shaft 55 which corresponds to the shaft 3 of FIG. 2 but is differently configurated, namely in such a manner that it can be used in a radial piston machine in which the high-pressure opening and the low-pressure opening may alternate. Identical components in FIG. 3 have been assigned the same reference numerals as before.

In FIG. 3, the shaft 55 is not provided with the channels 32, 33, 36 and 37. The configuration and arrangement of the recesses 30, 31, 34 and 35 of the grooves 19, 20 and 21 and of the fluid control openings 13 and 14 is the same as in FIGS. 1 and 2. The shaft 55 is provided with a blind bore 56 into the opening of which a cup-shaped sleeve 57 is press-fitted. A bore 58 penetrates the bottom wall of the sleeve 57 and establishes a communication between the interior of the housing and the interior of the bore 56. A slide 59 is accommodated in the bore 56 and is biased by a spring 60 which bears upon the sleeve 57 and it is located in a pressure compartment 58′ that is defined between the sleeve 57 and that end of the slide 59 which faces the sleeve 57. The slide 59 has a projection 61 which is pressed by the biasing spring 60 against a bottom wall 62 of the blind bore 56, this being the normal or starting end position of the slide 59. Between the bottom wall 62 and the end face of the slide 59 facing it, there is formed a pressure compartment 61′. A channel 63 extends from the opening 14 and communicates with the compartment 61′ immediately above the bottom wall 62 so that it remains open in all positions of the slide 59. A further bore 64 originates at the end face of the slide 59 which faces the sleeve 57 and communicates with a transverse bore 65 in the slide 59 which, in turn, communicates at both of its ends with an annular groove 66 on the slide 59. Two channels 67 and 68 communicate at diametrically opposite locations with the bore 56, and these channels also communicate with the recesses 30 and 31, respectively, that are located at opposite axial sides of the bore 13, the reference to "axial" referring to the axial length of the shaft 55.

In this embodiment, if the slide 59 engages with its projection 61 the bottom wall 62 of the blind bore 56, the groove 66 overlaps and communicates the openings of the two channels 67 and 68. Two further channels 69 and 70 communicate at diametrically opposite positions with the bore 56, the openings of these channels 69 and 70 being offset axially of the bore 56 in direction towards the sleeve 57 with reference to the openings of the channels 67 and 68; the channels 69 and 70 thus communicate the bore 56 with the recesses 34 and 35 which flank the opening 14. The groove 66 overlaps and communicates the openings of the channels 69 and 70 when the slide 59 abuts against the sleeve 57.

If, now, the opening 14 is the low-pressure fluid control opening, then the spring 60 urges the projection 61 of the slide 59 against the bottom wall 62 of the bore 56. In this position, the groove 66 overlaps the openings of the channels 67 and 68, thus communicating the recesses 30 and 31 via the channels 67 and 68, and the bores 65, 64 and 58 in slide 59 and sleeve 57 with the housing chamber 4′, so that the pressure prevailing in the housing chamber 4′ also develops in the recesses 30 and 31. In the region of the high-pressure control opening 13 the pressure drops in the gaps between the cylinder body 5 and the shaft 55, first linearly from the pressure of the opening 13 to the pressure prevailing in the grooves 19 and 20, and then again linearly from the pressure of the grooves 19 and 20 to the pressure of the chamber 4' which prevails in the recesses 30 and 31. Thus, a pressure distribution is obtained corresponding to the pressure distribution curve A of FIG. 3, which corresponds also to the pressure distribution in the region of the high-pressure control opening as described with respect to FIG. 2. In the previously described position of the slide 59, the latter closes the openings of the channels 69 and 70. In the region of what at this time is the low-pressure control opening 14, the pressure decreases linearly from the grooves 19 and 20 to the pressure of the opening 14, and again decreases linearly to the pressure of the chamber 4' that prevails at the end of the shaft 55 and also in the groove 21. In the region of the low-pressure control opening 14, a pressure distribution is obtained in the gap between the cylinder body 5 and the shaft 55 which is characterized by the curves E and E'. With this arrangement of the high-pressure and low-pressure control openings, the invention obtains a reduction in the supporting capability of the pressure fields which develop at the high-pressure side, according to the measure of the areas C and C' as shown in FIG. 2, whereas the grooves 34 and 35 at the low-pressure side have no effect.

If, on the other hand, it is the opening 14 that is the high-pressure control opening and the opening 13 that is the low-pressure control opening, then the slide 59 is exposed to high pressure via the channel 63 and is shifted counter to the force of the spring 60 until it abuts the sleeve 57. In so doing, the openings of the channels 67 and 68 are blocked which lead to the recesses 30 and 31 adjacent the opening 13, whereas now the recesses 34 and 35 adjacent the high-pressure control opening 14 are in communication—via the channels 69 and 70, the groove 66, the bores 65, 64 and 58—with the chamber 4'. It follows that the change in the function of the control openings 13 and 14 causes a change in the utilization of the recesses 30, 31 and 34, 35. Thus, the pressure fields previously mentioned are only exchanged and the equilibrium of forces and the desired gap configuration remain unchanged. The effect of this embodiment is to be seen in the fact that even during a change of the high-pressure opening to become a low-pressure opening, and vice versa, the supporting capability of the pressure fields in the region of that opening which at any given time is the high-pressure control opening is decreased by an amount which is characterized by the areas C and C' of the preceding embodiment, whereas the pressure fields in the region of the opening that is the low-pressure opening at any given time remain uninfluenced, so that the pressure curve here corresponds to that of radial piston machines known in the prior art.

In the embodiment of FIG. 3, as in the preceding embodiment, the displacement of the cylinder body 5 radially of the shaft 55 is a function of the configuration of the pressure fields and the adjustment of the equilibrium condition at decreased gap width at the high-pressure side is a function of the pressure which automatically develops in the grooves 19 and 20.

Figure 4:
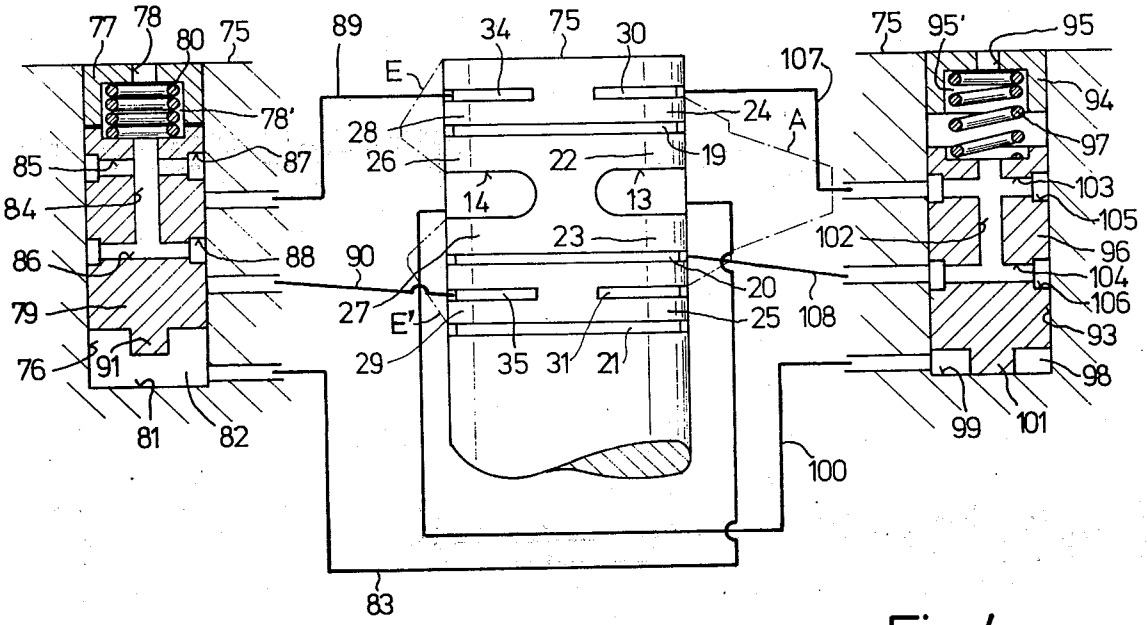
FIG. 4 is a view analogous to FIG. 3, but showing a piston machine according to yet a further embodiment of the invention.

FIG. 4 shows a further embodiment that differs from FIG. 3. In FIG. 4, the shaft 55 is replaced by a shaft 75 having two slides which control the supporting capability of the pressure fields in the gap between the shaft 75 and the cylinder body 5. Like reference numerals again identify like components as in the preceding embodiments.

The shaft 75 is formed with grooves and openings in the manner described in the preceding embodiment. In addition, it is also formed with a blind bore 76 into which a cup-shaped sleeve 77 is press-fitted. A bore 78 penetrates the bottom wall of the sleeve 77 and establishes a communication between the housing chamber 4' and a pressure compartment 78' which is enclosed between the sleeve 77 and a slide 79 which is sealingly but slidably accommodated in the bore 76. A spring 80 bears upon the sleeve 77 and upon the slide 79, and at the other end the slide 79 is subject to the pressure prevailing in a pressure compartment 82 which is defined between a bottom wall 81 of the bore 76 and an end face of the slide 79. A channel 83 communicates with the compartment 82 and with the opening 15. The slide 79 is formed with a blind bore 84 extending from that end face which is directed towards the sleeve 77 and which intersects two transverse bores that are formed in the slide 79 at a spacing from one another and identified with reference numerals 85 and 86. The transverse bore 85 communicates with an annular groove 87 formed in the periphery of the slide 79, and the transverse bore 86 communicates with a similar groove 88. The two annular grooves 87 and 88 are spaced from one another axially of the bore 76 by the same distance as the outlet openings of two channels 89 and 90 formed in the wall bounding the bore 76. The channels 89 and 90 are both formed in the interior of the shaft 75; the channel 89 communicates with the groove 34 and the channel 90 with the groove 35, both of which are located adjacent the opening 14. The annular grooves 87 and 88 overlie and communicate with the outlet openings of the channels 89 and 90 when the projection 91 formed at that end of the slide 79 which faces towards the bottom wall 81, is in abutment with this bottom wall, a condition which obtains when there is no pressure in the compartment 82.

A further blind bore 93 is formed in the shaft 75, and is also closed by a sleeve 94 which is press-fitted into it. A bore 95 penetrates the bottom wall of the sleeve 94 and communicates with the bore 93, or rather it communicates the chamber 4' with a pressure compartment 95 which is formed between the sleeve 94 and a slide 96 which is sealingly but slidably accommodated in the bore 93. Acting upon one end of the slide 96 is the pressure prevailing in a pressure compartment 93 that is formed between the bottom wall 99 of the bore 93 and the juxtaposed end face of the slide 96. A channel 100, originating in the opening 14, communicates with the pressure compartment 98 at such a location that it remains unclosed by the slide 96 even when the pin 101 formed on the slide 96 engages the bottom wall 99 of the bore 93. The slide 96 is further provided with a blind bore 102 which extends inwardly from that end face of the slide which faces the sleeve 94 and which intersects two transverse bores 103 and 104 which are formed in the slide but at axially spaced locations of the latter. The transverse bore 103 communicates with an annular groove formed in the periphery of the slide 96, and the transverse bore 104 communicates with a similar annular groove 106. These two grooves 105 and 106 are spaced from one another by the same distance as the openings of two channels 107 and 108 in the wall of the bore 93, of which the channel 107 also communicates with the recess 30 and the channel 108 with the recess 31, both of which are located adjacent the opening 13. Whenever the opening 13 is the high-pressure fluid control opening, slide 79 is placed under pressure from the compartment 82 and shifted counter to the force of the spring 80 towards the sleeve 77, so that the openings of the channels 89 and 90 are closed by the outer circumferential surface of the slide 79. The pressure compartment 98 on the other hand is communicated with the low-pressure opening (in this case, the opening 14) so that it also is at low pressure, with the result that the slide 96 is shifted by the force of the spring 97 until its projection 101 abuts the bottom 99 of the blind bore 93. In this position of the slide 96, the grooves 105 and 106 overlap the openings of the channels 107 and 108, so that the recesses 30 and 31 are subjected to the same pressure as the chamber 4′ via the channels 107, 108 and the bores 103, 104, 102 and 95.

In the region of the high-pressure control opening, in this case the opening 13, the pressure decreases linearly to the pressure prevailing in the grooves 19 and 20, which as in the preceding embodiment depends upon the pressure of the high-pressure control opening and the gap dimensions; from the grooves 19, 20 the pressure further decreases linearly to the pressure prevailing in the housing chamber 4′ which also obtains in the recesses 30 and 31. The pressure distribution curve is therefore the curve A which develops in this region, and which corresponds to the same curve that develops in the embodiment of FIG. 3 over the opening 13. In the region of the low-pressure control opening (here the opening 14), the pressure of the grooves 19, 20 decreases on the one hand linearly to the pressure of the opening 14 and again linearly to the pressure of the chamber 4′ at that end of the shaft 75 which faces towards the end cover 2 and which also prevails in the groove 21. The pressure curve in the region of the low-pressure control opening 14 therefore is the same as identified by the curves E and E′. Since the recesses 34 and 35 have no communication with other pressure sources and the channel 89 and 90 are closed, they have no influence upon the pressure decrease in the gap.

If, now, the relationship is reversed and the opening 14 becomes the high-pressure control opening and the opening 13 the low-pressure control opening, then low pressure will prevail in the compartment 82 and the slide 79 will be shifted by the spring 80 until its projection 91 will abut the bottom 81 of the bore 76. In this position, the grooves 87 and 88 overlap the openings of the channels 89 and 90 so that the grooves 34 and 35 adjacent the opening 14 are in communication with the pressure prevailing in the housing chamber 4′. At the same time, the slide 96 is subjected to high pressure from the compartment 98 and is shifted counter to the force of the spring 97 into abutment with the sleeve 94, thereby closing the openings of the channels 107, 108 and interrupting the communication of the recesses 30, 31 with the chamber 4′. As the openings 13 and 14 change back and forth between high pressure and low pressure, the pressure prevailing in the recesses adjacent the openings 13 and 14 also keeps changing, so that the pressure curve in the region of the two openings 13 and 14 becomes constantly interchanged. This embodiment corresponds in its effect to the one described with respect to the embodiment in FIG. 3.

Figure 5:
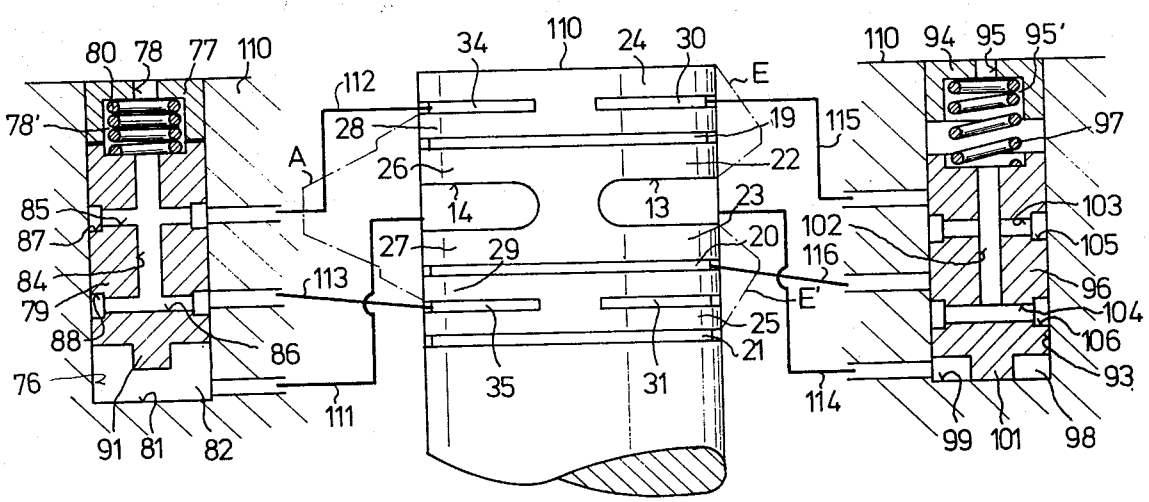
FIG. 5 is a view similar to FIG. 4 illustrating an additional embodiment of the invention.

FIG. 5 shows still a further embodiment wherein the shaft 110 corresponds to the shaft 75 in FIG. 4. Again, like reference numerals identify like components as before.

In FIG. 5, the shaft 110 again has the compartment 82 via which pressure fluid is applied to the slide 79. This compartment 82 is connected via a channel 111 with the pressure fluid control opening 14. A channel 112 extends from the recess 34 and a similar channel 113 extends from the recess 35, both of these channels communicating with the blind bore 76 in such a manner that their openings that communicate with the bore are overlapped by the annular grooves 87 and 88 when high pressure prevails in the compartment 82 and presses the slide 79 against the sleeve 77. On the other hand, when the projection 91 of the slide 79 abuts the bottom wall 81 of the blind bore 76, the slide 79 blocks the openings of the channels 112 and 113. In the same manner, the compartment 98 of the blind bore 93 communicates with the control opening 13 via a channel 114. A channel 115 extends from the recess 30 and a channel 116 extends from the recess 31; the channels 115 and 116 communicate with the bore 93 at locations which are spaced from one another by a distance corresponding to the axial spacing of the annular grooves 105 and 106. The slide 96 closes the openings of the channels 115 and 116 when its projection 101 engages the bottom wall 99. The grooves 105 and 106 overlie and communicate with the openings of the channels 115 and 116 when the slide 96 is pressed against the sleeve 94 due to the presence of pressure in the compartment 98.

It will be evident that in the region of the high-pressure control opening, in the gap between the cylinder body 5 and the shaft 110, there will be a pressure curve which corresponds to the curve A, and in the region of the low-pressure control opening, the pressure curves will correspond to the curves E and E′. As the pressure of the openings changes, i.e., as the opening 13 becomes low pressure and the opening 14 high pressure, or vice versa, the pressure curve in the region of the respective opening will correspondingly change, so that this embodiment corresponds in its operation to the one in FIG. 5.

Figure 6:
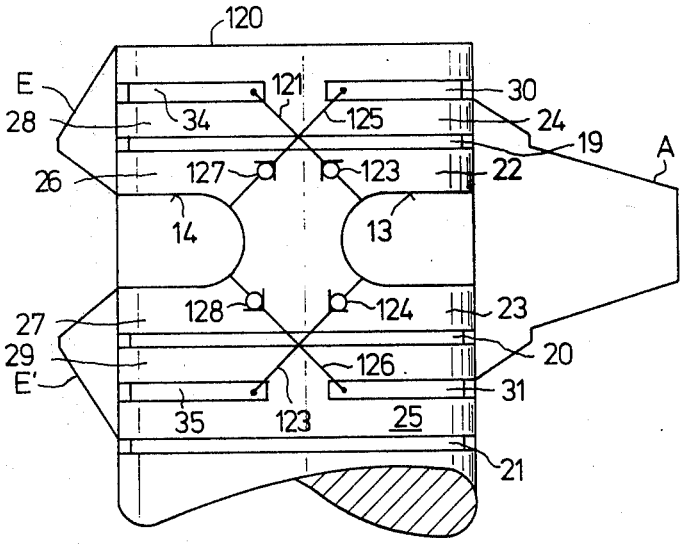
FIG. 6 is a fragmentary plan view showing details of the shaft of another machine according to the invention.

FIG. 6 shows a shaft 120 which is a simplified version of the embodiment shown in FIG. 3. The shaft 120 has fluid control openings, recesses and annular grooves in the same manner as in the preceding embodiments, and like reference numerals again identify like elements. A channel 121 is provided in the shaft 120 and communicates the opening 13 with the recess 34, whereas a similar channel 122 communicates the opening 13 with the recess 35. A one-way valve 123 is mounted in the channel 121 and blocks the flow of pressure fluid from the opening 13 to the groove 34; a similar valve 124 is provided in channel 122 and blocks the flow of pressure fluid to the recess 35. A third channel 125 in the shaft 120 communicates the recess 30 with the opening 14 and a fourth channel 126 communicates the recess 31 with the opening 14. A one-way valve 127 in the channel 125 blocks the channel with respect to the fluid flow towards the recess 30, and a similar valve 128 blocks channel 126 against fluid flow towards the recess 31.

In this embodiment, if the opening 13 is the high-pressure fluid opening, the valves 123 and 124 prevent the high-pressure fluid from flowing into the recesses 34 and 35. The pressure which develops in the grooves 19 and 20 as a result of pressure fluid which flows from the opening 13, is decreased in the region of the opening 14 to the pressure which prevails in the chamber 4′ and in the groove 21, and the pressure distribution curves are those identified with E and E′. The recesses 34 and 35 do not act at this time. In the region of the high-pressure opening 13, the pressure in the gap between the cylinder body 5 and the shaft 120 decreases from the high-pressure opening 13 to the pressure prevailing in the grooves 19, 20 and from there again to the pressure prevailing in the recesses 30, 31 which is equal to the pressure of the low-pressure opening 14, because as soon as the pressure in the recesses 30, 31 increases due to pressure fluid that flows out of the grooves 19, 20 and exceeds the pressure in the low-pressure opening 14, the valves 127, 128 will open in the direction towards the opening 14 and permit an outflow of pressure fluid from the recesses 30, 31 and a corresponding decrease in the pressure. The pressure distribution curve is the one identified with reference character A. If in this embodiment the high-pressure opening and the low-pressure opening are exchanged, that is if the previously high-pressure opening becomes the low-pressure opening and the previously low-pressure opening becomes the high-pressure opening, the pressure curves in the region of the openings 13 and 14 will again become interchanged, that is where a curve previously corresponded to the curve A of FIG. 6, it will then correspond to the curve E and E′, and vice versa.

Thus, the embodiment of FIG. 6 causes a reduction in the supporting capability of the pressure fields at the respective high-pressure side, and in this manner it results in a reduction of the gap height in radial direction, and thus in a reduction of the leakage losses, analogous to the embodiments in FIGS. 3–5. The setting and maintaining of the equilibrium condition takes place as in the embodiment of FIGS. 3–5, i.e., the pressure will automatically set itself in the grooves 19, 20.

Figure 7:
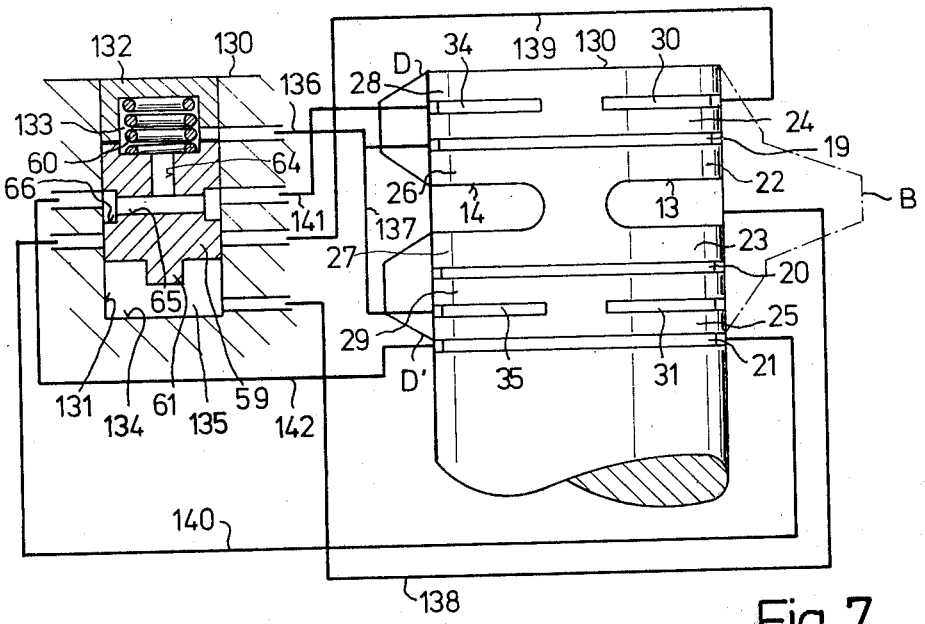
FIG. 7 is a view similar to FIG. 3, but illustrating yet another embodiment of the invention.

The embodiment of FIG. 7 is a modification of the one shown in FIG. 3. Like reference numerals again identify like elements.

In FIG. 7 it is the shaft 130 which mounts the cylinder body 5 for rotation. The shaft 130, which has an arrangement permitting the supporting capability of the pressure fields at the low-pressure side to be controlled, has the fluid control openings 13, 14, the circumferential grooves and the part-circumferential recesses as in the preceding embodiments. In addition, shaft 130 is formed with a blind bore 131 which is closed by a press-fitted cup-shaped sleeve 132 and accommodates the slide 59. A first pressure compartment 133 is formed in bore 131 intermediate sleeve 132 (i.e., the end wall of the sleeve) and the end face of the slide 59 which faces the sleeve end wall; the biasing spring for slide 59 is located in this compartment 133. A second pressure compartment 135 is formed in bore 131 intermediate the bottom wall 134 thereof and that end face of slide 59 which faces the bottom wall 134.

A channel 136 in the shaft 130 communicates to compartment 133 with the groove 19; in turn, the channel 136 communicates with the groove 20 via a further channel 137. This provides for pressure equalization between the grooves 19, 20 and the compartment 133.

Another channel 138 is also formed in shaft 130; it communicates the control opening 13 with the compartment 135. Channels 139 and 140 extend from the recesses 30 and 31, respectively, and communicate with bore 131 at diametrally opposite locations. These channels communicate with the compartment 133 via the groove 66 and the bores 65 and 64, when the slide 59 is in that one of its end positions in which its projection 61 abuts the bottom wall 134 of bore 131. Two further channels 141 and 142 extend from recesses 34 and 35, respectively, and communicate with bore 131 at diametrally opposite locations which are, however, spaced axially of the bore 131 from the locations where the channels 139 and 140 communicate with it, in direction towards the sleeve 132 and to such an extent the openings of channels 141 and 142 will be closed by the slide 59 as long as the latter is in its aforementioned end position in which the groove 66 cooperates with channels 139 and 140.

In FIG. 7, each of the openings 13, 14 may be either a high-pressure opening or a low-pressure opening. When the opening 13 is the high-pressure opening the compartment 133 will also be at high pressure; as a result, the fluid pressure in compartment 133 shifts the slide 59 counter to the force of spring 60 into abutment with the end wall of sleeve 132. In this position the slide 59 blocks the channels 139, 140 but connects the channels 141, 142 via the bores 65 and 64 with the compartment 133. Therefore, the same pressure as in grooves 19, 20 will prevail in the recesses 34, 35 which flank the opening 14 that at this time is the low-pressure opening.

In the region of the high-pressure opening 13 this results in a linear pressure drop from opening 13 to the grooves 19, 20; a further linear pressure drop will exist from grooves 19, 20 to the end of shaft 130 or groove 21, respectively. The result will be pressure distribution curve B, upon which the recesses 30, 31 do not exert any influence. In the region of the low-pressure opening 14, on the other hand, the pressure decreases from that prevailing in grooves 19, 20 to the lower pressure prevailing in opening 14. Intermediate groove 19 and recess 34 the pressure remains constant, but it drops towards the end of shaft 130 to the lower pressure prevailing in chamber 4′. Similarly, the pressure intermediate groove 20 and recess 35 remains constant, but the pressure drops towards the groove 21 to the pressure prevailing in chamber 4′. The result will be the two equal pressure distribution curves D and D′.

The embodiment of FIG. 7 offers the advantage that the supporting capability of the pressure fields at the low-pressure side is strengthened, whereby the gap height (in radial direction) at the high-pressure side is decreased and leakage losses are correspondingly reduced.

If the pressure relationship is changed, i.e., if opening 13 becomes the low-pressure opening and opening 14 becomes the high-pressure opening, e.g., due to a reversal of the direction of rotation of cylinder body 5, the spring 60 shifts the slide 59 until the projection 61 thereof abuts bottom wall 134 of bore 131. In this position the groove 66 communicates with the open ends of channels 140, 141 so that the recesses 30, 31 are now subjected to the fluid pressure prevailing in compartment 136, whereas the channels 141, 142 communicating with recesses 34, 35 are blocked. It is evident that this results in a reversal of the pressure relationships in the region of the openings 13, 14, as compared to the relationship described above, so that in this condition, also, pressure fields of increased supporting capability are obtained at the low-pressure side, leading at the high-pressure side to a reduced gap height which is maintained in effect due to the automatic pressure adjustment that takes place in grooves 19, 20.

If the assumption is made that the pressure differences between the grooves 19 and 20 are negligible, then the embodiment of FIG. 7 could be further simplified by connecting the compartment 133 only with the groove 19, or only with the groove 20, via an appropriate channel.

Figure 8:
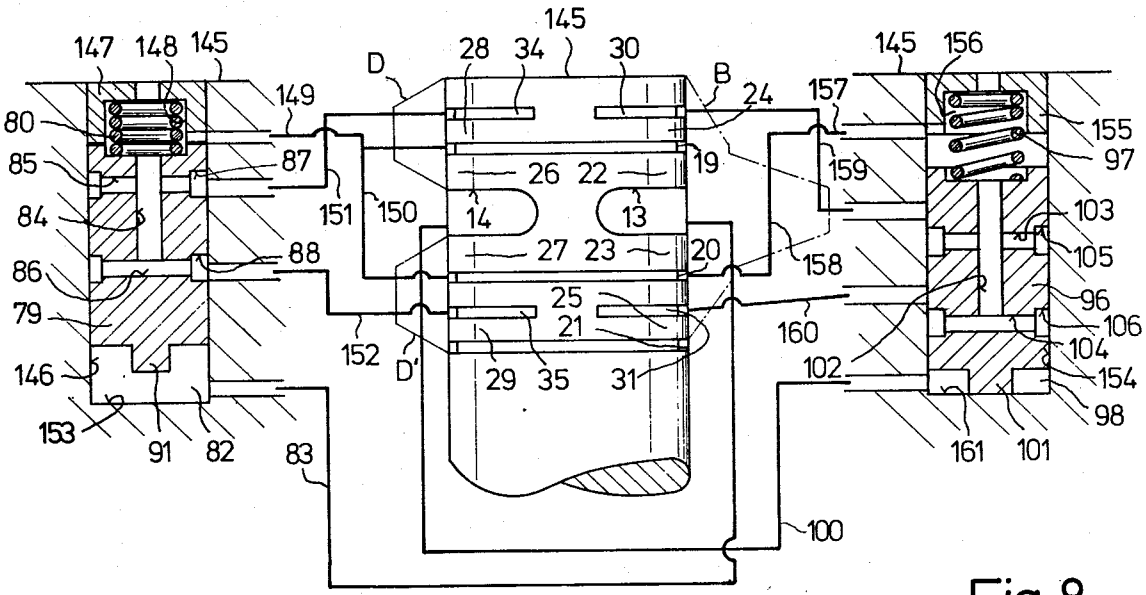
FIG. 8 is similar to FIG. 7 but shows an additional embodiment of the invention.

The embodiment of FIG. 8 is a modification of the one shown in FIG. 4. Like reference numerals again identify like elements as before.

The shaft 145 which in FIG. 8 mounts the cylinder body 5 for rotation, is provided with an arrangement for increasing the supporting capability of the pressure fields at the low-pressure side, i.e., for increasing their strength.

Shaft 145 is provided with the openings 13, 14, the grooves and the recesses as before. In addition it is provided with a blind bore 146 into the open end of which a sleeve 147 is inserted, e.g., by press-fitting. The slide 79 is shiftably received in bore 146; it defines with the end wall of sleeve 147 a first pressure compartment 148 and with the bottom wall 153 of bore 146 the second pressure compartment 82. A biasing spring 80 for slide 79 is located in compartment 148, and the latter communicates with the groove 19 via a channel 149. Channel 149 in turn communicates with groove 20 via a further channel 150. Channels 151 and 152 extend from recesses 34 and 35, respectively, and communicate with bore 146. The openings of these channels in the wall bounding bore 146 communicate with the grooves 87, 88 of slide 79 when the latter is shifted into abutment with the endwall of sleeve 147 by the pressure in compartment 82.

The shaft 145 is additionally formed with another fluid bore 154 which has a cupped sleeve 155 inserted into its open end. The slide 96 is shiftably received in bore 154 and bounds with the endwall of sleeve 155 a pressure compartment 156 and with the bottom wall 161 of bore 154 the pressure compartment 98. Biasing spring 97 for slide 96 is located in compartment 156. A channel 154 communicates compartment 156 with groove 19 and is in turn communicated with groove 20 via a channel 158. Channels 159 and 160 communicate with recesses 30 and 31, respectively, and have open ends that communicate with bore 154 and which are open to the grooves 105, 106 of slide 96 when the latter is in its end position in which it abuts the end wall of sleeve 155. The open ends of channels 159 and 160 are closed, however, when the slide 96 is in its other end position in which its projection 101 abuts the bottom wall 161 of bore 154.

In FIG. 8 each of the openings 13, 14 may either be the high-pressure opening or the low-pressure opening. When opening 13 is the high-pressure opening, then the pressure in compartment 82 shifts slide 79 to a position in which the grooves 19, 20 communicate with recesses 34, 35; the pressure distribution that is then obtained in the region of the low-pressure opening 14 is identified by curves D, D'. The slide 96, on the other hand, which is subjected to the low pressure of compartment 98, blocks the openings of channels 159, 160 to thereby prevent the recesses 30 and 31 from exerting any effect. Thus, the pressure distribution in the gap between cylinder body 5 and shaft 145 at the high-pressure side corresponds to curve B.

When the functions of openings 13, 14 are reversed, i.e., when opening 13 becomes the low-pressure opening and opening 14 becomes the high-pressure opening, the pressure relationships in the regions of these openings also become reversed from what was described above. Thus, the effectiveness of this embodiment, in terms of increasing the strength and supporting capability of the pressure fields at the low-pressure side, remains unchanged.

Figure 9:
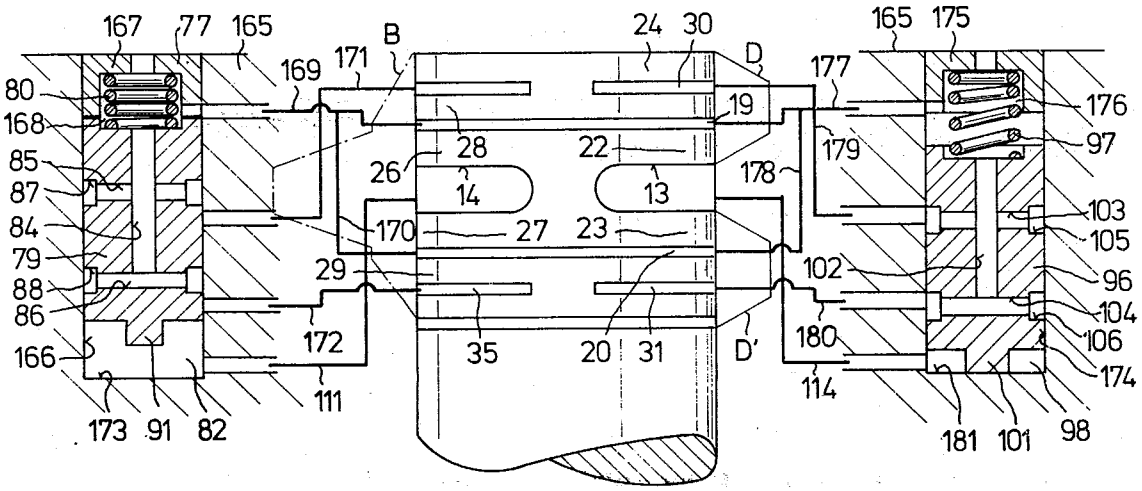
FIG. 9 is analogous to FIG. 8, but illustrates a machine according to a further embodiment.

FIG. 9 shows an embodiment where the shaft 165, which mounts cylinder body 5 for rotation, is intended for a rotary piston machine wherein the high-pressure side and the low-pressure side become alternately interchanged, and wherein an arrangement is provided for influencing the pressure fields at the low-pressure side. The embodiment of FIG. 9 is a modification of that in FIG. 5 and like reference numerals identify like elements as in FIG. 5.

The shaft 165 of FIG. 9 is formed with a fluid bore 166 whose open end has a cup-shaped sleeve 167 inserted into it. The slide 79 is shiftably received in bore 166 and bounds with the end wall of sleeve 167 a pressure compartment 168 accommodating the biasing spring 80 for the slide 79. A channel 169 communicates with compartment 168 and with groove 19; a further channel 170 communicates with channel 169 and with groove 20. Channels 171 and 172 communicate bore 166 with recesses 34 and 35, respectively; the openings of channels 171 and 172 into the bore 166 communicate with the grooves 87 and 88 of slide 79 when the latter is in a position in which its projection 91 abuts the bottom wall 173 of bore 166; these openings are blocked by the slide 79 when the latter is in its other end position in which it abuts the end wall of sleeve 167.

A further fluid bore 174 in shaft 165 has a cupped sleeve 175 inserted into its open and accommodates the slide 96 which bounds with the sleeve 175 a pressure compartment 176. The biasing spring 97 for slide 96 is received in compartment 176. A channel 177 communicates compartment 176 with groove 19 and is in communication with groove 20 via a further channel 178.

Channels 179 and 180 communicate bore 174 with the recesses 30 and 31, respectively. Their open ends communicating with bore 174 are so located that they will be in communication with the grooves 105, 106 of slide 96 when the latter is in its end position in which its projection 101 abuts the bottom wall 181 of bore 174.

In FIG. 9 each of the openings 13, 14 may be either the high-pressure opening or the low-pressure opening. At such times as the opening 14 is the high-pressure opening, the slide 79 is subject to high pressure and is shifted to its position in which it blocks the channels 171 and 172, so that the pressure in the gap between the shaft 165 and the cylinder body 5 decreases from opening 14 to the grooves 19, 20 and from the latter to the end of shaft 165, respectively to the groove 21. At this time, however, the slide 96 abuts bottom wall 181 with its projection 101, and in this position the recesses 30, 31 communicate with grooves 19, 20 via channels 179, 180, grooves 105, 106, bores 103, 104 and channels 177, 178, so that pressure equalization takes place between them. Thus, in the region of the high-pressure opening 14 the pressure distribution obtained in the gap between shaft 165 and the cylinder body 5 is the one identified by the curve B, whereas the pressure curve in the region of the low-pressure opening 13 is characterized by the curves D and D'.

A reversal of the pressure conditions, i.e., when the opening 14 becomes the low-pressure opening and the opening 13 becomes the high-pressure opening, causes a similar exchange of the pressure conditions in recesses 34, 35 with those in recess 30, 31, thus assuring that the pressure conditions in the region of the respective high-pressure opening and the respective low-pressure opening continue to be the same as described above. The effect of the FIG. 9 embodiment, namely to strengthen the pressure fields at the low-pressure side in order to increase their supporting capability, thus corresponds to the effect obtained with the two preceding embodiments.

Figure 10:
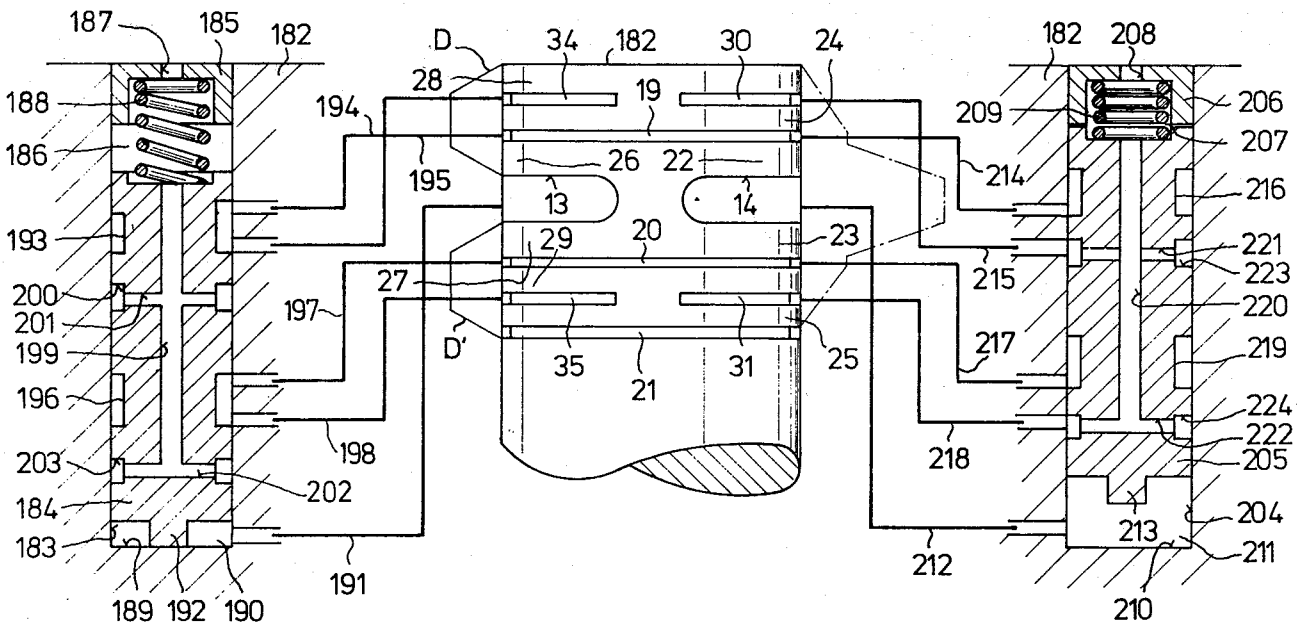
FIG. 10 shows a concomitant embodiment of the invention in a view similar to FIG. 9.

The embodiment of FIG. 10 is a modification of the one in FIG. 2; like reference numerals identify like components as in FIG. 2.

The FIG. 10 embodiment is of a radial piston machine wherein the high-pressure side and the low-pressure side alternate during rotation of the cylinder body 5 on the shaft 182.

Shaft 182 has the openings 13, 14, the grooves and the recesses as described with reference to FIG. 2. In addition it is provided with a fluid bore 183 whose open end has installed in it — e.g., by press-fitting — a cup-shaped sleeve 185. A slide 184 is shiftably received in bore 183 and bounds with sleeve 185 a pressure compartment 186. The end wall of sleeve 185 is formed with a bore 187 which communicates the compartment 186 with the interior of the machine housing, i.e., with chamber 4' (See FIG. 1). A biasing spring 188 is received in compartment 186 and bears upon sleeve 185 and slide 184, respectively. A further pressure compartment 190 is bounded by the slide 184 and the bottom wall 189 of bore 183. Compartment 190 communicates with the opening 14 via a channel 191 in the shaft 182. Slide 184 has a projection 192 which abuts the bottom wall 189 when compartment 190 is at low pressure. The circumference of slide 184 is formed with several circumferential grooves. Of these, the relatively wide (in axial direction of slide 184) groove 193 is closest to the sleeve 185 and communicates the openings of channels 194 and 195 which extend to groove 19 and recess 34, respectively, when the slide 184 is in a position in which its projection 192 abuts the bottom wall 189.

Substantially midway of its length the slide 184 is formed with another relatively wide circumferential groove 189 which, when the slide 184 is in its position in which projection 192 abuts bottom wall 189, communicates the open ends of channels 197 and 198 which respectively extend from groove 20 and recess 35 to the bore 183.

The slide 184 is also formed with an axially extending blind bore 199 which intersects two transverse bores 201 and 202 which respectively communicate with circumferential grooves 200 and 203 of the slide 184. Groove 200 is located intermediate grooves 193 and 196; groove 203 is closest to that end of slide 184 which faces bottom wall 189. The grooves 200 and 203 are so arranged that, when the slide 184 is in its end position in which it abuts the sleeve 185, the groove 200 communicates with the open end of channel 195 and the groove 203 communicates with the open end of channel 198.

In addition to the blind bore 183 the shaft 182 is provided with a further blind bore 204 whose open end has a cup-shaped sleeve 206 press-fitted into it. A slide 205 is shiftably received in bore 204 and bounds with sleeve 206 a pressure compartment 207 and with the bottom wall 210 of bore 204 a pressure compartment 211. The end wall of the sleeve 206 is formed with a bore 208 through which compartment 207 communicates with chamber 4' (see FIG. 1). A biasing spring 209 acting upon slide 205 is located in compartment 207. A channel 212 communicates compartment 211 with opening 13. When there is no pressure in compartment 211, the spring 209 biases slide 205 to a position in which its projection 213 abuts the bottom wall 210.

Channels 214 and 215 communicate with groove 19 and recess 30, respectively; their open ends communicate with bore 204. Channels 217 and 218 communicate with groove 20 and recess 31, respectively; their open ends also communicate with bore 204. When the slide 205 is in a position in which its projection 213 abuts bottom wall 210, a relatively broad circumferential groove 216 on slide 205 communicates the channels 214 and 215 with one another, while another relatively broad circumferential groove 219 on slide 205 communicates the channels 217 and 218. The slide 205 is also provided with an axially extending blind bore 220 which intersects transverse bores 221 and 222 in the slide. The bores 221 and 222 respectively communicate with further circumferential grooves 223 and 224. When slide 205 is in a position in which it abuts sleeve 206, groove 223 communicates with channel 215 whereas groove 224 communicates with the channel 218.

When the opening 13 is the high-pressure opening, slide 205 is biased by fluid pressure into abutment with sleeve 206. As a result, the recess 30 is subjected to the pressure of chamber 4' (see FIG. 1) via channel 215, groove 223, bore 221 and bore 220; the same pressure is also supplied to recess 31 via channel 218, groove 224, bore 222, bore 220 and bore 208 in sleeve 206. Spring 188 moves slide 184 until its projection 192 abuts the bottom wall 189 of bore 183, so that groove 193 communicates the channels 194 and 195 with one another while groove 196 communicates the channels 197, 198 with one another. The result will be an equalization of pressure between groove 19 and recess 34, and between groove 20 and recess 35. In the region of the low-pressure opening (at this time opening 14) the pressure decreases from recess 34 towards the end of shaft 182, where the pressure of chamber 4' prevails, and the pressure also drops from groove 19 to the opening 14, namely to the pressure at opening 14. Similarly, the pressure drops from groove 20 to the pressure of opening 14, and from recess 35 to the pressure of groove 21. As a result, the pressure distribution curves D and D' are obtained. In the region of the high-pressure opening 13 the pressure in the gap between cylinder body 5 and shaft 182 decreases linearly from the pressure level at opening 13 to the pressure level of grooves 19, 20, and from these grooves the pressure further decreases linearly to the pressure level of recesses 30, 31 which is equal to the pressure in chamber 4'. The pressure distribution curve which is obtained is represented by the curve A.

When opening 13 becomes the low-pressure opening and opening 14 becomes the high-pressure opening, the pressure relationships described above will become similarly interchanged and the effectiveness of the device is unimpaired by this change.

The embodiment of FIG. 10 has the particular advantage that even when the pressure levels prevailing in openings 13 and 14 are interchanged, a weakening of the pressure fields at the high-pressure side by the amount indicated by areas C and C′ in FIG. 1 will be obtained, whereas a strenthening of the pressure fields at the low-pressure side will take place which equals the amount indicated by areas F and F′ in FIG. 1. This assures that at the high-pressure side the radial gap between cylinder body 5 and shaft 182 will be small, with concomitant low fluid leakage losses. The adjustment and regulation of the equilibrium conditions is the same as in the preceding embodiments.

Figure 11:
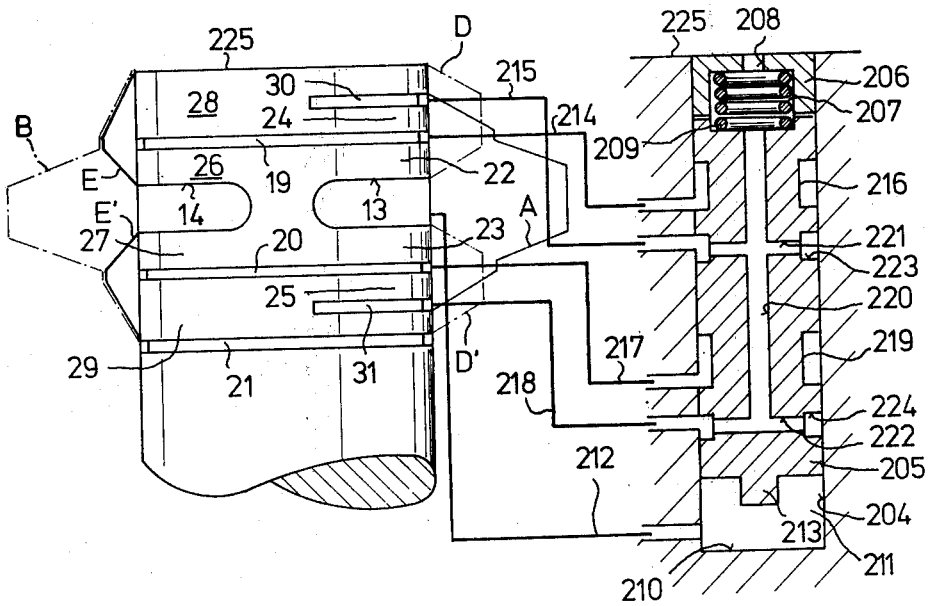
FIG. 11 is a view similar to FIG. 7, but illustrating yet an additional embodiment of the invention.

Finally, FIG. 11 shows an embodiment that is a modification of the one in FIG. 10, in that its shaft 225 is of a simpler construction than the shaft 182 of FIG. 10. Like reference numerals identify like components.

The shaft 225 resembles the shaft 182 of FIG. 10 in all particles, except that the recesses 34, 35, the bline bore 183, and slide 184, and the channels associated with these elements, are omitted in shaft 225. In all other respects, the embodiment of FIG. 11 corresponds to that of FIG. 10.

When the opening 13 in FIG. 11 is the high-pressure opening, the slide 205 is pushed into abutment with sleeve 206 by the pressure in compartment 211, so that the recess 30 is placed in communication with the pressure in chamber 4′ (see FIG. 1) via channel 215, groove 223, bore 221 and bore 220. Recess 31 is similarly connected with chamber 4′ via channel 218, groove 224, bore 222 and bore 220.

In the gap between cylinder body 5 and shaft 225 the pressure decreases from that prevailing in high-pressure opening 13 linearly to the pressure in grooves 19 and 20, and from there the pressure further linearly decreases to the pressure of chamber 4′ which prevails in recesses 30 and 31. This yields a pressure distribution corresponding to curve A. In the region of the low-pressure opening 14 the pressure drops in one direction from that prevailing in grooves 19, 20 to the pressure of opening 14, and in the other direction to the pressure of chamber 4′ which prevails at the end of shaft 225, respectively in groove 21, so that the pressure curves E and E′ are obtained.

Conversely, when the opening 14 is the high-pressure opening and the opening 13 is the low-pressure opening, low pressure acts in compartment 211 upon slide 205, so that the spring 209 is able to shift slide 205 until its projection 213 abuts the bottom wall 210 of bore 204. When the slide 205 is in this position its groove 219 connects the channels 214 and 215, and the groove 219 connects the channels 217 and 218. In the region of the opening 13 — which is now the low-pressure opening — there now prevails intermediate groove 19 and recess 30 the pressure which exists in groove 19 and which decreases in one direction towards the opening 13 and in the other direction towards the end of shaft 225. Intermediate the groove 20 and the recess 30 there prevails the pressure which exits in groove 20 and which decreases in one direction towards the opening 13 and in the other direction towards the groove 21 which is at the pressure of chamber 4′. One thus obtains in the region of the low-pressure opening the two pressure distribution curves which are shown in chain lines. The pressure of high-pressure opening 14 linearly decreases towards the grooves 19, 20, and from there the pressure linearly decreases further to the end of shaft 225, respectively to the groove 21, where the pressure of chamber 4′ prevails. This results in the pressure distribution curve B which is shown in chain lines.

FIG. 11 has the particular advantage that the pressure fields in the region of the respective high-pressure opening 13 or 14 are weakened, whereas the pressure fields in the region of the respective low-pressure opening 14 or 13 are strengthened. This assures maintenance of a small radial gap height in the region of the respective high-pressure opening (and therefore low leakage losses), despite the interchange between the high-pressure and low-pressure control functions of openings 13 and 14. The setting and regulation of the forece equilibrium in this embodiment is the same as that explained with respect to FIG. 1.

In the embodiments described herebefore the grooves 19, 20 are circumferentially complete. This could, however, be modified, by replacing them with two circumferential grooves which are provided substantially in the region of the openings 13, 14 and which are connected with one another by a channel in the shaft, so that identical pressure in the process would be obtained at the high-pressure side and at the low-pressure side, nevertheless.

The embodiments of FIGS. 3–5 and 7–11 could be modified by replacing the biasing springs for the respective slides with a fluid connection, so as to fluid-bias the slides in lieu of the spring bias. The opposite end of the respective slide will always be subject to the pressure prevailing in one of the openings 13, 14; if the springs are to be omitted, then the end of the slide which was previously engaged by the spring must now be subjected to the fluid pressure in the respective other opening 14 or 13. The compartment in which the respective spring was previously received (and which is FIGS. 3, 4, 5, 10 and 11 was subject to the pressure in chamber 4; and in FIGS. 7, 8 and 9 was subject to the pressure in grooves 19, 20) should then be constructed as an annular groove in the wall bounding the bore which accommodates the slide. The slide would have to be made larger.

It will be understood that each of the elements described above, or two or more together, may also find a useful application in other types of constructions differing from the types described above.

While the invention has been illustrated and described as embodied in a radial piston machine, it is not intended to be limited to the details shown, since various modifications and structural changes may be made without departing in any way from the spirit of the present invention.

We claim:

1. A radial piston machine, comprising a housing; a shaft in said housing and formed with two axially spaced circumferential grooves bounding first spaces and intermediate said grooves with a high-pressure fluid control opening and with a diametrally opposite low-pressure fluid control opening, sealing lands intermediate said control openings and said circumferential grooves, a first and a second set of supporting lands adjacent said circumferential grooves at the axially outwardly directed sides thereof, a first pair of part-circumferential recesses formed in said first set and axially flanking said high-pressure fluid control opening and a second pair of part-circumferential recesses formed in said second set and axially flanking said low-pressure fluid control opening; a cylinder body rotatably mounted on said shaft and formed with cylinder bores having inner ends which intermittently communicate with the respective control openings; pistons reciprocable in the respective cylinder bores; and means communicating the recesses of at least one of said pairs with at least one space of a plurality of spaces which plurality is constituted by said first spaces and by a second space having a fluid pressure lower than that of said high-pressure fluid control opening.

2. A radial piston machine as defined in claim 1, wherein said means communicates said recesses of said first pair with the interior of said housing.

3. A radial piston machine as defined in claim 1, wherein said means communicates said recesses of said first pair with said low-pressure fluid control opening.

4. A radial piston machine as defined in claim 1, wherein said means comprises connecting channels formed in said shaft, and a flow-control slide in at least one of said channels for controlling the fluid flow therethrough.

5. A radial piston machine as defined in claim 1, wherein said means comprises connecting channels formed in said shaft, and a flow-control slide in at least one of said channels, said shaft being a bore and said slide being movable in said bore and having one endface which bounds a first pressure compartment that communicates with one of said fluid-control openings, and another endface which bounds a second pressure compartment that communicates with the interior of said housing and wherein a biasing spring is located which bears upon said slide.

6. A radial piston machine as defined in claim 1, wherein said means comprises connecting channels formed in said shaft, two bores in said shaft, a slide in each of said bores and each having one endface bounding a first pressure compartment communicating with one of said fluid-control openings and another endface bounding a second pressure compartment which is part of the respective bore and communicates with the interior of said housing, a biasing spring in each second compartment and bearing upon the respective slide, said channels comprising sets of channels which communicate said recesses with said bores, each slide being movable between a first end position which it assumes when the associated fluid-control opening is at high fluid pressure and in which it communicates said channels with said second compartment, and a second end position in which it blocks said channels, said slides always being located in mutually opposite ones of said end positions.

7. A radial piston machine as defined in claim 1, wherein said means comprises two sets of channels, each set including at least one channel communicating the respective fluid-control opening with the recesses of the pair flanking the respective other fluid-control opening, and a one-way valve blocking said channel in direction towards said reccesses.

8. A radial piston machine as defined in claim 1, said shaft having a bore, a slide sealingly received in said bore and having one endface bounding a first pressure compartment that communicates with one of said fluid-control openings and another endface bounding a second pressure compartment that communicates with at least one of said circumferential grooves, a biasing spring in said second compartment and bearing upon said slide, first channels communicating with a first location of said bore and with the recesses flanking said one fluid-control opening, second channels communicating with a different second location of said bore and with the recesses flanking the other of said fluid-control openings, said slide being movable between a first position in which it communicates said second channels with said second compartment when said first compartment is at high pressure, and a second position in which it communicates said first channels with said second compartment when said first compartment is at low pressure.

9. A radial piston machine as defined in claim 1, wherein said shaft is formed with two bores, a slide received in each of said bores and having one endface bounding a first pressure compartment communicating with a respective one of said fluid-control openings and another endface bounding a second pressure compartment communicating with at least one of said circumferential grooves and accommodating a biasing spring bearing upon the respective slide, and channels communicating said bore with said recesses, said slides each being movable between a first end position in which it communicates said channels with said second pressure compartment when said first compartment is at high pressure, and a second end position in which it blocks said channels when said first compartment is at low pressure.

10. A radial piston machine as defined in claim 1, wherein said shaft is formed with two bores, a slide in each of said bores, each slide having one endface bounding a first pressure compartment communicating with a respective one of said fluid-control openings and another endface bounding a second pressure compartment which communicates with at least one of said circumferential grooves and which accommodates a biasing spring bearing upon the respective slide, first channels communicating one of said bores with the recesses flanking one of said fluid-control openings and second channels communicating the other of said bores with the recesses flanking the other of said fluid-control openings, each slide being movable between a first end position in which it blocks the associated channels when the fluid-control opening communicating with the bore is at high pressure, and a second end position in which it communicates the associated channels with the respective second compartment, said slides always being located in mutually opposite ones of said end positions.

11. A radial piston machine as defined in claim 1, wherein said shaft is formed with two bores, a slide received in each bore, each slide having one endface bounding a first pressure compartment which communicates with a respective one of said fluid-control openings, and another endface which bounds a second pressure compartment that communicates with the interior of said housing and accommodates a biasing spring acting upon the respective slide, channels communicating each bore with respective ones of said recesses and grooves, each slide being movable between a first end position in which it communicates the respective channels with said second compartment when said first compartment is at high pressure, and a second end position in which it communicates a channel leading to the respective circumferential groove with a channel leading to the respective recesses which is adjacent said respective circumferential groove, said slides always being located in mutually opposite ones of said end positions.

12. A radial piston machine as defined in claim 1, wherein said means communicates said recesses of said first pair with said second space and communicates said recesses of said second pair with said circumferential grooves.

13. A radial piston machine as defined in claim 1, wherein said means communicates said recesses of said second pair with said circumferential grooves.

14. A radial piston machine as defined in claim 1, wherein said means comprises connecting grooves formed in the periphery of said shaft.

15. A radial piston machine as defined in claim 14, wherein a first pair of said channels extend from said recesses of the pair flanking said one fluid-control opening to said bore and communicate therewith, a second pair of said channels extending from said recesses of the pair flanking the other of said fluid-control openings to said bore and communicating with the same at a location spaced from said first pair, said slide being movable being a first end position in which it connects said first pair of channels with said second compartment when high pressure prevails in said first compartment, and said slide also being movable to a second end position in which it connects said second pair of channels with said second compartment when low pressure prevails in said first compartment.

16. A radial piston machine as defined in claim 1, wherein said means comprises connecting channels formed in said shaft, two bores formed in said shaft, a slide received in back of said bores, each slide having one end-face bounding a first pressure compartment that communicates with a respective one of said fluid-control openings and another endface that bounds a pressure compartment which is part of the respective bore and communicates with the interior of said housing and which accommodates a biasing spring that bears upon the respective slide.

17. A radial piston machine as defined in claim 16, wherein said channels comprise sets of channels extending from said recesses to said bores, each slide being movable between a first end position which it assumes when said first compartment is at high fluid pressure and in which it blocks and channels, and another end position in which it communicates said channels with said second compartment when said first compartment is at low fluid pressure, said slides always being located in mutually opposite ones of said end positions.

18. A radial piston machine comprising a housing; a shaft in said housing and formed with two axially spaced circumferential grooves and intermediate the same with a high-pressure fluid-control opening and with a diametrally opposite low-pressure fluid control opening, sealing lands intermediate said control openings and said circumferential grooves, a first and a second set of supporting lands adjacent said circumferential grooves at the axially outwardly directed sides thereof, a pair of part-circumferential recesses formed in one of said sets and axially flanking the associated fluid control opening; a cylinder body rotatably mounted on said shaft and formed with cylinder bores which accommodate pistons and have inner ends which intermittently communicate with the respective control openings; and a bore formed in said shaft and accommodating a slide having a first endface bounding a first pressure compartment communicating with said associated fluid-control opening and another endface bounding a second pressure compartment which communicates with the interior of said housing and accommodates a biasing spring bearing upon said slide, channels communicating said bore with said circumferential grooves and with said recesses, said slide being movable between a first end position in which it connects said recesses via the respective channels with said second compartment and a second end position in which it connects each of said circumferential grooves with the respective one of said recesses which is located adjacent to the groove.

* * * * *